US006317921B1

(12) United States Patent
Park et al.

(10) Patent No.: US 6,317,921 B1
(45) Date of Patent: Nov. 20, 2001

(54) STICK-TYPE VACUUM CLEANER

(75) Inventors: Jung-su Park, Jungeup; Yun-sup Hwang, Kwangju, both of (KR)

(73) Assignee: SamSung Kwangju Electronics Co. Ltd., Kwangju (KR)

( * ) Notice: Subject to any disclaimer, the term of this patent is extended or adjusted under 35 U.S.C. 154(b) by 0 days.

(21) Appl. No.: 09/464,407

(22) Filed: Dec. 16, 1999

(30) Foreign Application Priority Data

Aug. 13, 1999 (KR) ..... 99-33340
Aug. 13, 1999 (KR) ..... 99-33341

(51) Int. Cl.[7] ..... A47L 5/00
(52) U.S. Cl. ..... 15/334; 15/351
(58) Field of Search ..... 15/331, 334, 335

(56) References Cited

U.S. PATENT DOCUMENTS 3,869,751 * 3/1975 Boyd et al. ..... 15/334
4,376,322 * 3/1983 Lockhart et al. ..... 15/334 X
4,519,113 * 5/1985 Hipple ..... 15/335
5,355,549 * 10/1994 Steinberg et al. ..... 15/334
5,617,611 * 4/1997 Worwag ..... 15/335 X
5,713,103 * 2/1998 Keebler et al. ..... 15/334 X
6,079,077 * 6/2000 Kajihara et al. ..... 15/334 X

* cited by examiner

*Primary Examiner*—Chris K. Moore
(74) *Attorney, Agent, or Firm*—Robert E. Bushnell, Esq.

(57) ABSTRACT

A stick-type vacuum cleaner capable of performing a cleaning process by using an auxiliary tool without having to separate a brush assembly from a suction pipe, including: a body having main and auxiliary suction channels; a dust collecting cup having main and auxiliary suction ports which are communicated with the main and auxiliary suction channels, respectively; a flexible hose arranged to be communicated with the auxiliary suction channel, the flexible hose whose outlet portion is attached to the auxiliary tool; means for selectively blocking the main suction channel; means for selectively blocking a suctioning of air through the auxiliary suction channel; and a motor-fan system for generating an air flow, which moves through the main suction channel and the auxiliary suction channel, and then into the dust collecting cup.

23 Claims, 16 Drawing Sheets

STICK-TYPE VACUUM CLEANER

CLAIM OF PRIORITY

This application makes reference to, incorporates the same herein, and claims all benefits accruing under 35 U.S.C. §119 from applications for STICK-TYPE VACUUM CLEANER earlier filed in the Korean Industrial Property Office on Aug. 13, 1999 and there duly assigned Ser. No. 33340/1999, and for STICK-TYPE VACUUM CLEANER earlier filed in the Korean Industrial Property Office on Aug. 13, 1999 and there duly assigned Ser. No. 33341/1999.

BACKGROUND OF THE INVENTION

1. Field of the Invention

The present invention relates to a vacuum cleaner, and more particularly to a stick-type vacuum cleaner enabling a user to clean recessed places such as a stairway, etc. more easily.

2. Description of the Prior Art

FIG. 1A shows one example of a conventional stick-type vacuum cleaner. FIGS. 1B and 1C are detailed views of the main portions shown in FIG. 1A. As shown, the conventional stick-type vacuum cleaner includes a body 10, a dust collecting cup 20, a motor-fan system 30, and a handle 40.

The body 10 includes first and second housings 11 and 12 which are coupled with each other by coupling means (not shown) such as screws, etc. The first and second housings 11 and 12 form a space therebetween by being coupled with each other, and in the space defined between the first and second housings 11 and 12, the motor-fan system 30 is arranged.

A suction pipe 14 is formed on one side of the second housing 12, having a suction channel 13 therein. An upstream portion of the suction pipe 14 is selectively connected with a brush assembly 50 for cleaning a floor, and an auxiliary tool 50' (See FIG. 2) for cleaning recessed places.

The dust collecting cup 20 is detachably connected with one side of the body 10, and as shown in FIG. 1C, the dust collecting cup 20 includes a suction port 15 communicated with the suction channel 13. The suction port 15 has a valve plate 25 for preventing a back flow of dust which is drawn into the dust collecting cup 20.

A filter 24 is arranged at an outlet portion of the dust collecting cup 20, to filter out the dust entrained in the air, and to collect the dust.

The motor-fan system 30 functions to generate an air flow moving through the brush assembly 50 and the suction channel 13, and then into the dust collecting cup 20. A filter 17 is positioned at an upstream portion of the motor-fan system 30, to prevent any dust from being sucked into the motor-fan system 30.

A plurality of discharge slots 16 are formed on the first housing 11, to permit the air, which is drawn into the body 10 by the motor-fan system 30, to be discharged out therethrough. Further, an auxiliary handle 18 is formed on the first housing 11 for enabling the user to handle the vacuum cleaner more easily when he/she cleans recessed places such as stairs, etc.

As shown in FIG. 1B, at the front lower side of the dust collecting cup 20, a detaching button 22 having a hook 21 is biased outward by a spring 23. On the second housing 11, an interlocking portion 21' is formed at the position corresponding to the hook 21 to be interlocked with the hook 21 of the detaching button 22. Accordingly, the dust collecting cup 20 is detachably mounted on one side of the body 10 by the detaching button 22.

In the conventional stick-type vacuum cleaner constructed as above, when the motor-fan system 30 is operated, an air flow is generated, and the air flows through the brush assembly 50, the suction channel 13, and the suction port 15, and then into the dust collecting cup 20.

The dust is entrained in the air while the air is drawn into the body 10 of the vacuum cleaner through the brush assembly 50, and flows through the suction channel 13, the suction port 15, and then into the dust collecting cup 20, where the dust is finally collected by the filter formed therein.

Accordingly, in order to clean the floor, the user holds the handle 40 of the vacuum cleaner, and keeps tight contact of the lower surface of the brush assembly 50 with the floor, while moving the vacuum cleaner. Automatically, the floor cleaning process is performed as the dust on the floor is suctioned into the vacuum cleaner.

Meanwhile, in order to clean the recessed places such as stairs and gaps between floor boards, etc., the user separates the brush assembly 50 from the suction pipe 14, and fits the auxiliary tool 50' to the suction pipe 14 (See FIG. 2). Then, the user performs the cleaning process, moving the vacuum cleaner while holding the handle 40 and the auxiliary handle 18.

According to the conventional stick-type vacuum cleaner constructed as above, however, it is bothersome for the user to clean the recessed places or the gaps with the auxiliary tool 14, since the user has to separate the brush assembly 50 and fixes the auxiliary tool 50' with respect to the suction pipe 14 whenever he/she wants to use the auxiliary tool 50'.

Further, according to the conventional stick-type vacuum cleaner constructed as above, while the user performs the cleaning process with the auxiliary tool 50' as shown in FIG. 2, the user has to keep carrying the vacuum cleaner, which is quite heavy, by holding the handle 40 and the auxiliary handle 18 with both hands.

SUMMARY OF THE INVENTION

The present invention has been developed to overcome the above-mentioned problems of the prior art, and accordingly, it is an object of the present invention to provide a stick-type vacuum cleaner enabling a user to perform a cleaning process by using an auxiliary tool without separating the brush assembly from the suction pipe.

Another object of the present invention is to provide a stick-type vacuum cleaner enabling a user to perform a cleaning process by using the auxiliary tool without having to carrying the vacuum cleaner by holding the vacuum cleaner with both hands during the cleaning process.

The above object is accomplished by a stick-type vacuum cleaner including: a dust collecting cup having a suction port formed thereon; a body having main and auxiliary suction channels which are communicated with the suction port; an adaptor body connected to the body, and having a connecting channel communicated with the auxiliary suction channel; a valve rotatably connected with the adaptor body at a position where the main and auxiliary suction channels meet, for selectively communicating the main suction channel and the auxiliary suction channel with the suction port; and a motor-fan system for generating an air flow which moves through the main and auxiliary channels, and then into the dust collecting cup.

Here, the adaptor body includes a valve separating prevention protrusion to be fitted in a recess formed on the valve, for preventing the separation of the valve from the adaptor body.

Further, the adaptor body includes a pair of valve turning prevention protrusions, between which locking protrusions formed on the valve are selectively placed to communicate the main suction channel or the auxiliary suction channel with the suction port.

Further, the above object is accomplished by a stick-type vacuum cleaner according to the present invention, including: a body having main and auxiliary suction channels; a dust collecting cup having main and auxiliary suction ports which are communicated with the main and auxiliary suction channels, respectively; a flexible hose arranged to be communicated with the auxiliary suction channel, the flexible hose whose outlet portion is attached to the auxiliary tool; means for selectively blocking the main suction channel; means for selectively blocking an air suction through the auxiliary suction channel; and a motor-fan system for generating an air flow which moves through the main suction channel and the auxiliary suction channel, and then into the dust collecting cup.

Here, the main suction channel blocking means is a valve formed on the main suction channel, and the means for blocking the air suction through the auxiliary suction channel, is a cap for blocking an inlet of the auxiliary tool by being fitted with an inlet portion of the auxiliary tool.

Further, the above object is accomplished by a stick-type vacuum cleaner according to the present invention, including: a dust collecting cup having main and auxiliary suction ports formed thereon; a body having main and auxiliary suction channels communicated with the main and auxiliary suction ports, respectively; an adaptor body connected with the body, and having a connecting channel communicated with the auxiliary suction channel; a valve rotatably connected with the adaptor body, for selectively blocking the main suction channel of the body; a flexible hose having one end which is connected with the adaptor body and communicated with the connecting channel, and another end which is connected with the auxiliary tool; a cap detachably connected with an inlet portion of the auxiliary tool, to block the inlet of the auxiliary tool; and a motor-fan system for generating an air flow which moves through the main suction channel and the auxiliary suction channel, and then into the dust collecting cup.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Hereinafter, the preferred embodiment of the present invention will be described in greater detail with reference to the accompanied drawings.

Figure 1A:
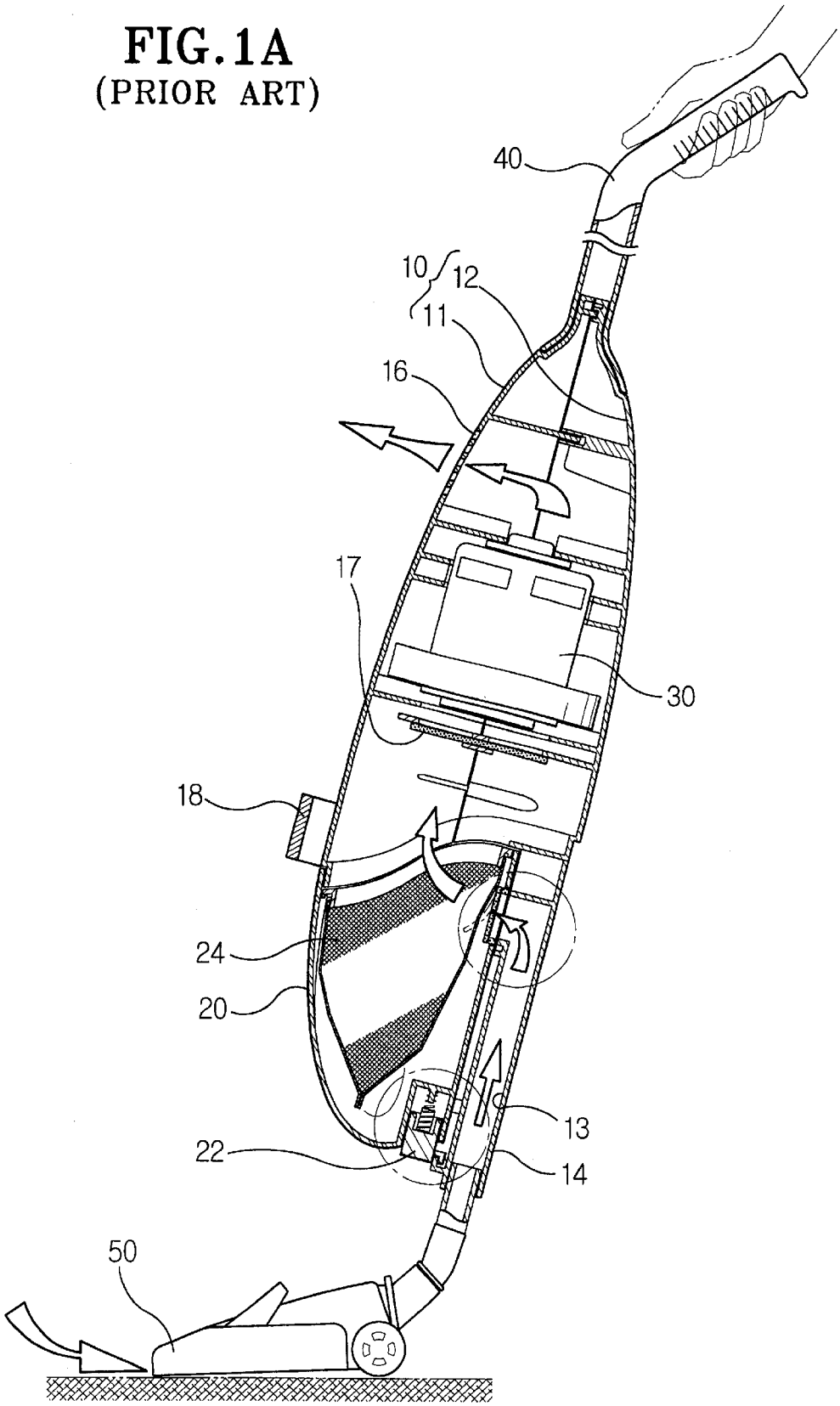
FIG. 1A (PRIOR ART)
FIG. 1A is a sectional view of a conventional stick-type vacuum cleaner, showing a user cleaning a floor with a brush assembly.
Figure 1B:
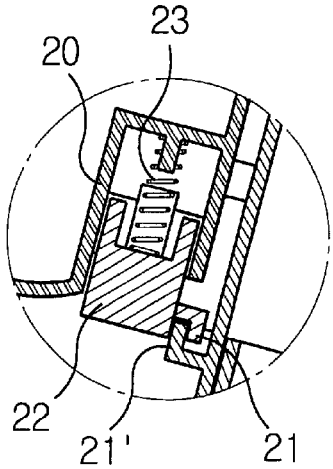
FIG. 1B (PRIOR ART)
FIGS. 1B and 1C are expanded sectional views for showing the main portions of the conventional stick-type vacuum cleaner shown in FIG. 1A.
Figure 1C:
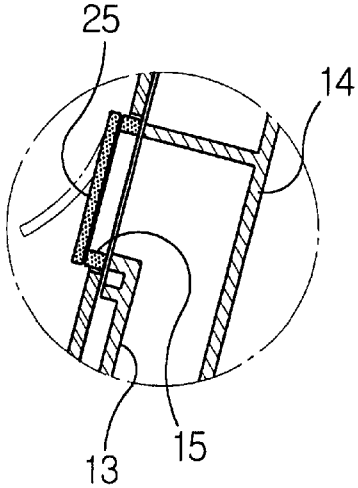
FIG. 1C (PRIOR ART)
Figure 2:
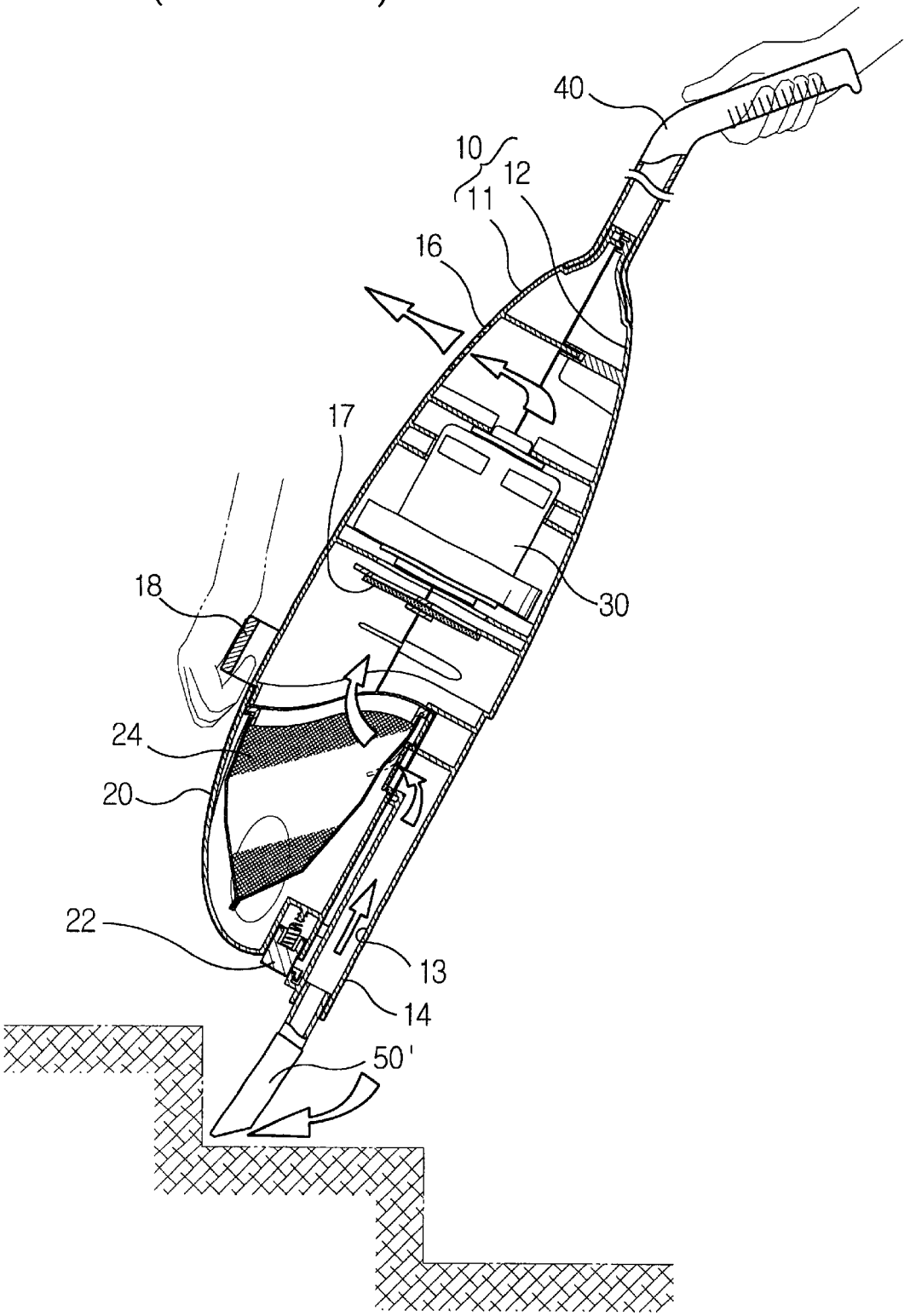
FIG.2 (PRIOR ART)
FIG. 2 is a sectional view of the conventional vacuum cleaner, showing a user cleaning a stair with an auxiliary tool.
Figure 3A:
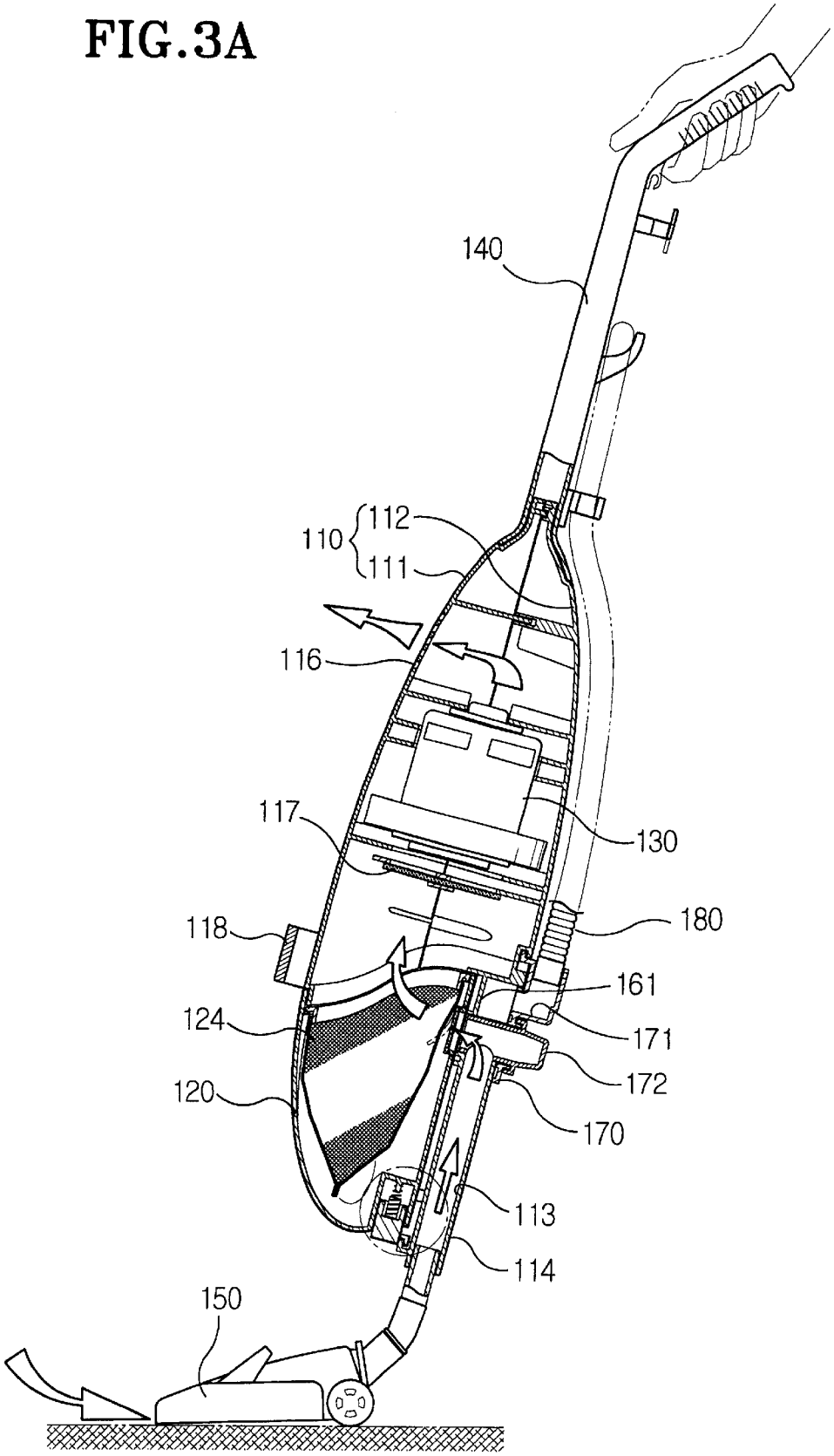
FIG. 3A is a sectional view of a stick-type vacuum cleaner according to one preferred embodiment of the present invention, showing a user cleaning a floor with the brush assembly.

FIGS. 3A to 5 show a stick-type vacuum cleaner according to one preferred embodiment of the present invention. Referring to FIG. 3A, the stick-type vacuum cleaner according to one preferred embodiment of the present invention includes a body 110, a dust collecting cup 120, a motor-fan system 130, and a handle 140.

The body 110 includes first and second housings 111 and 112 which are coupled with each other by coupling means (not shown) such as screws, etc. In the space defined by the first and second housings 111 and 112 which are coupled with each other, the motor-fan system 130 is arranged.

Figure 4:
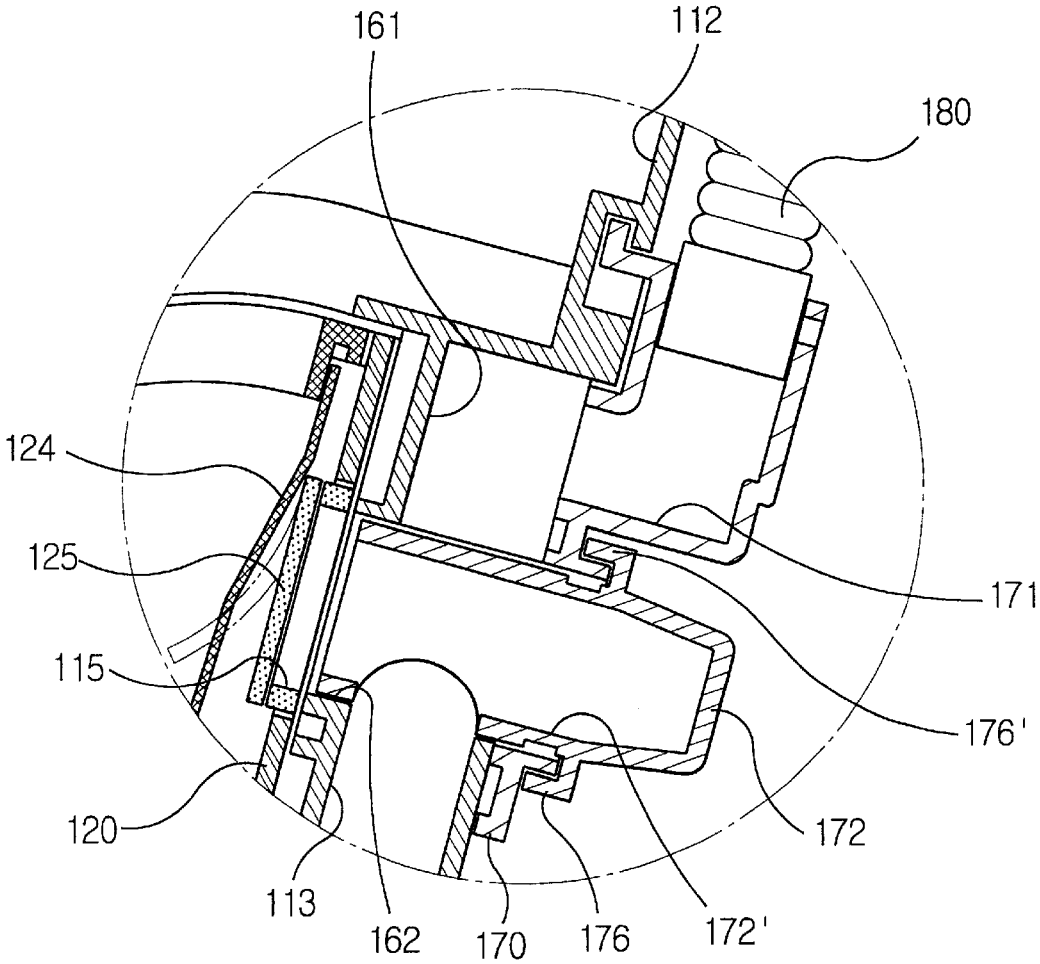
FIG. 4 is an expanded sectional view of the stick-type vacuum cleaner of FIG. 3A.

On one side of the second housing 112, a main suction channel 113 and an auxiliary suction channel 161 are formed. Further, as shown in FIG. 4, at the place where the main and auxiliary suction channels 113 and 161 meet, a hole 162 is formed in perpendicular relation to the main and auxiliary channels 113 and 161. To an upstream portion of the suction pipe 114 which has the main suction channel 113 therein, a brush assembly 150 is detachably connected for cleaning a floor.

The dust collecting cup 120 is detachably connected with one side of the body 110, and has a suction port 115 which is communicated with the hole 162 of the second housing 112. The suction port 115 has a valve plate 125 for preventing a back flow of a dust which flows in the dust collecting cup 120. A filter 124 is disposed at an outlet portion of the dust collecting cup 120, to filter out the dust entrained in the air, and to collect the dust.

Further, an adaptor body 170 is connected on the second housing 112. The adaptor body 170 has a connecting channel 171 formed on one side of the adaptor body 170. The connecting channel 171 is communicated with the auxiliary suction channel 161 of the second housing 112. The connecting channel 171 is connected with one side of a flexible hose 180, and the other side of the flexible hose 180 is connected with the auxiliary tool 181 for cleaning recessed places.

Further, on the other side of the adaptor body 170, a valve coupling hole 172' is formed at a position corresponding to the hole 162 of the second housing 112. A valve 172 is coupled with the valve coupling hole 172', for selectively communicating the main and auxiliary suction channels 113 and 161 with the suction poll 115 of the dust collecting cup 120.

Figure 5:
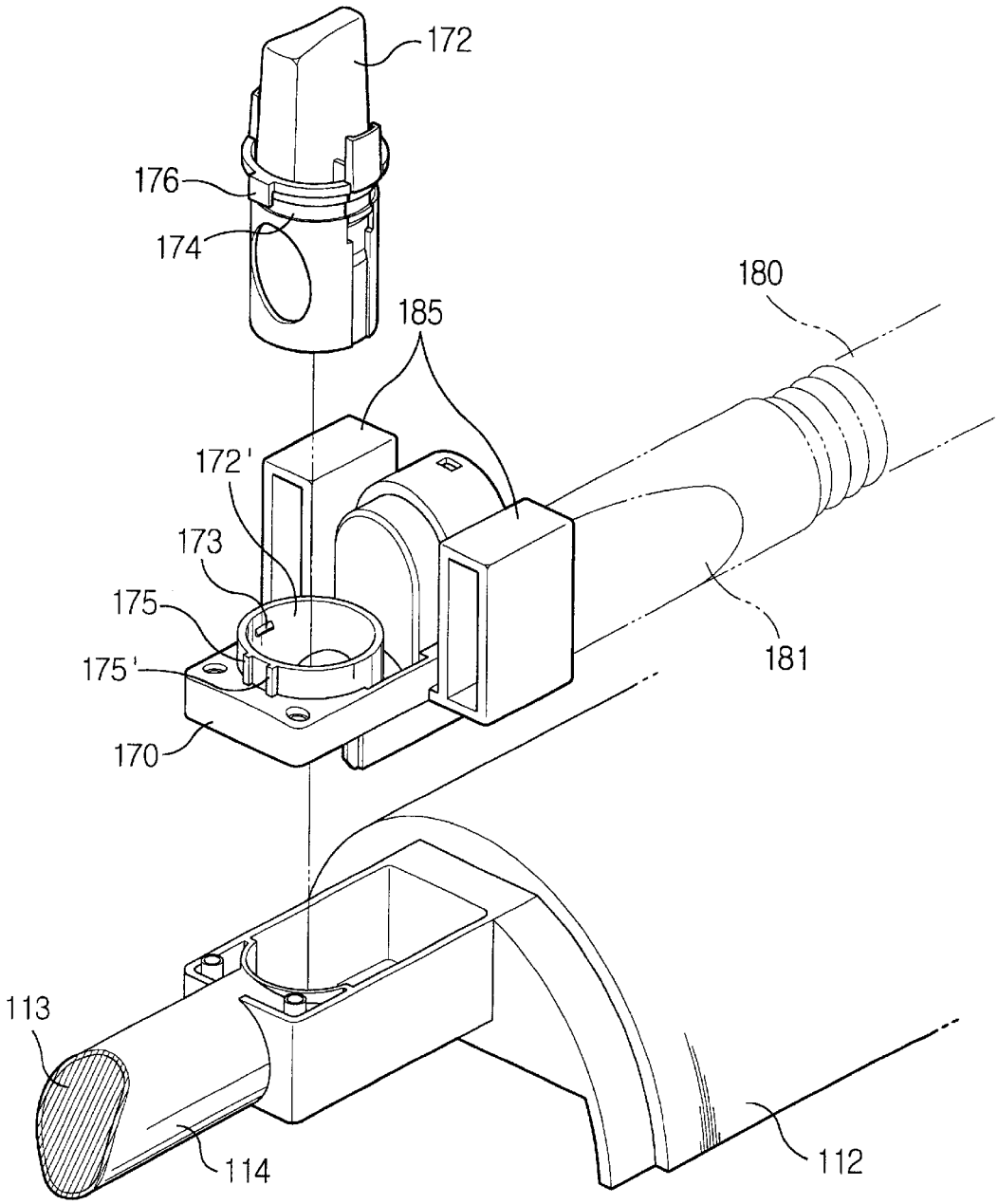
FIG. 5 is an exploded perspective view for showing the main portion of the stick-type vacuum cleaner according to one preferred embodiment of the present invention.

As shown in FIG. 5, a valve separating prevention protrusion 173 is formed on the inner side of the valve coupling hole 172', while a recess 174 is formed on the outer side of the valve 172, to receive the valve separating prevention protrusion 173. Accordingly, as the valve separating prevention protrusion 173 is fit in the recess 174 formed on the valve 172, the separation of the valve 172 from the adaptor body 170 is prevented.

Further, a pair of valve turning prevention protrusions 175 and 175' are formed on the adaptor body 170, while a pair of locking protrusions 176 and 176' are formed on the valve 172 to be selectively locked between the pair of valve turning prevention protrusions 175 and 175' of the adaptor body 170. Accordingly, as the locking protrusions 176 and 176' (See FIG. 5) are selectively locked between the pairs of valve turning prevention protrusions 175 and 175', the main suction channel 113 is communicated with the suction port 115 (See FIG. 4), or the auxiliary suction channel 161 is communicated with the suction port 115 (Sec FIG. 7).

A pair of auxiliary holders 185 are integrally formed on both sides of the connecting channel 171 of the adaptor body 170, to hold the auxiliary tool 181. Although there can be only one auxiliary tool holder 185, here, for a more convenience in handling, the embodiment of the present invention employs a pair of auxiliary tool holders 185.

A plurality of discharge slots 116 are formed on the first housing 111, for permitting the air, which is suctioned by the motor-fan system 130, to be discharged outward therethrough. Further, an auxiliary handle 118 is formed on an upper surface of the first housing 111, for a user's convenience in handling the vacuum cleaner when cleaning the recessed places such as stairs, etc.

Figure 3B:
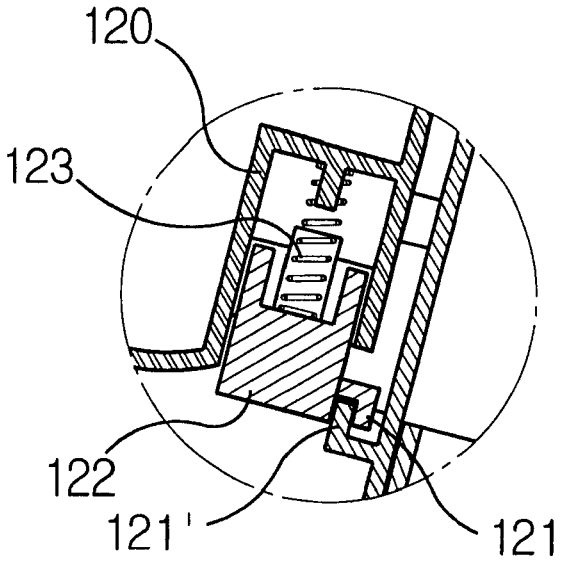
FIG. 3B is an expanded sectional view for showing the main portion of the stick-type vacuum cleaner of FIG. 3A.

As shown in FIG. 3B, at the front lower side of the dust collecting cup 120, a detaching button 122 having a hook 121 is biased outward by a spring 123. Further, an interlocking protrusion 121' is formed on the second housing 111 at a position corresponding to the hook 121 of the detaching button 122, to be interlocked with the hook 121. Accordingly, by manipulating the detaching button 122, the dust collecting cup 120 is connected/disconnected to/from one side of the body 110.

In the stick-type vacuum cleaner constructed as above according to one preferred embodiment of the present invention, when the valve 172 is at the position shown in FIGS. 3A and 4, the air is not suctioned through the auxiliary suction channel 161. Accordingly, when the motor-fan system 130 is operated, the air flow is generated, flowing through the brush assembly 150, the main suction channel 113, and the suction port 115, and then into the dust collecting cup 120.

As a result, the dust and the air that are drawn into the brush assembly 150, flow through the main suction channel 113 and the suction port 115, and then into the dust collecting cup 120 where the dust is filtered out by the filter 124 disposed therein.

Accordingly, in order to clean the floor with the vacuum cleaner, the user moves the vacuum cleaner while holding the handle 140 of the vacuum cleaner and maintaining tight contact of the lower side of the brush assembly 150 with the floor. Automatically, the floor cleaning process is performed as the dust on the floor is suctioned into the vacuum cleaner.

Figure 6:
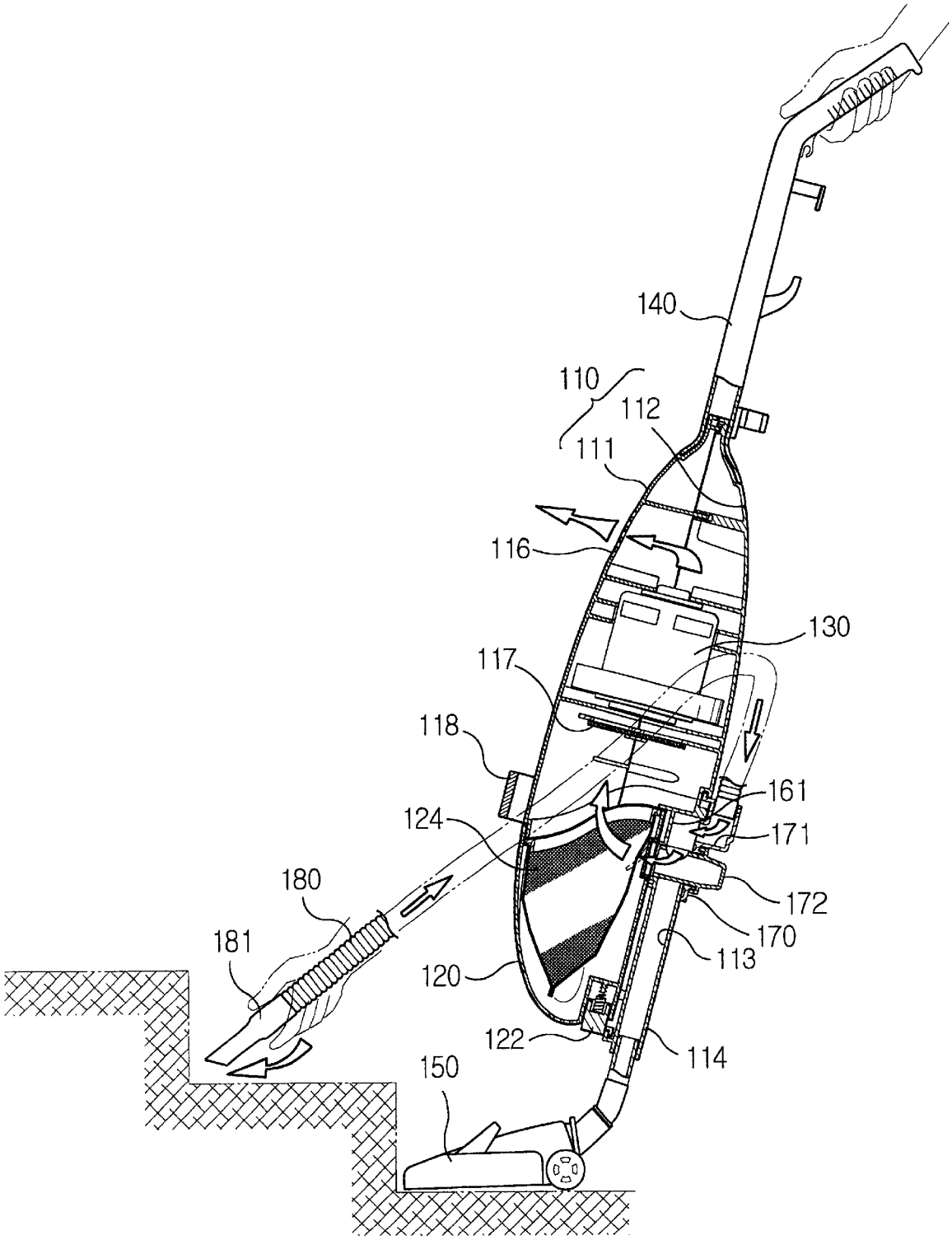
FIG. 6 is a sectional view of the stick-type vacuum cleaner according to one preferred embodiment of the present invention, showing a user cleaning a stair with an auxiliary tool.
Figure 7:
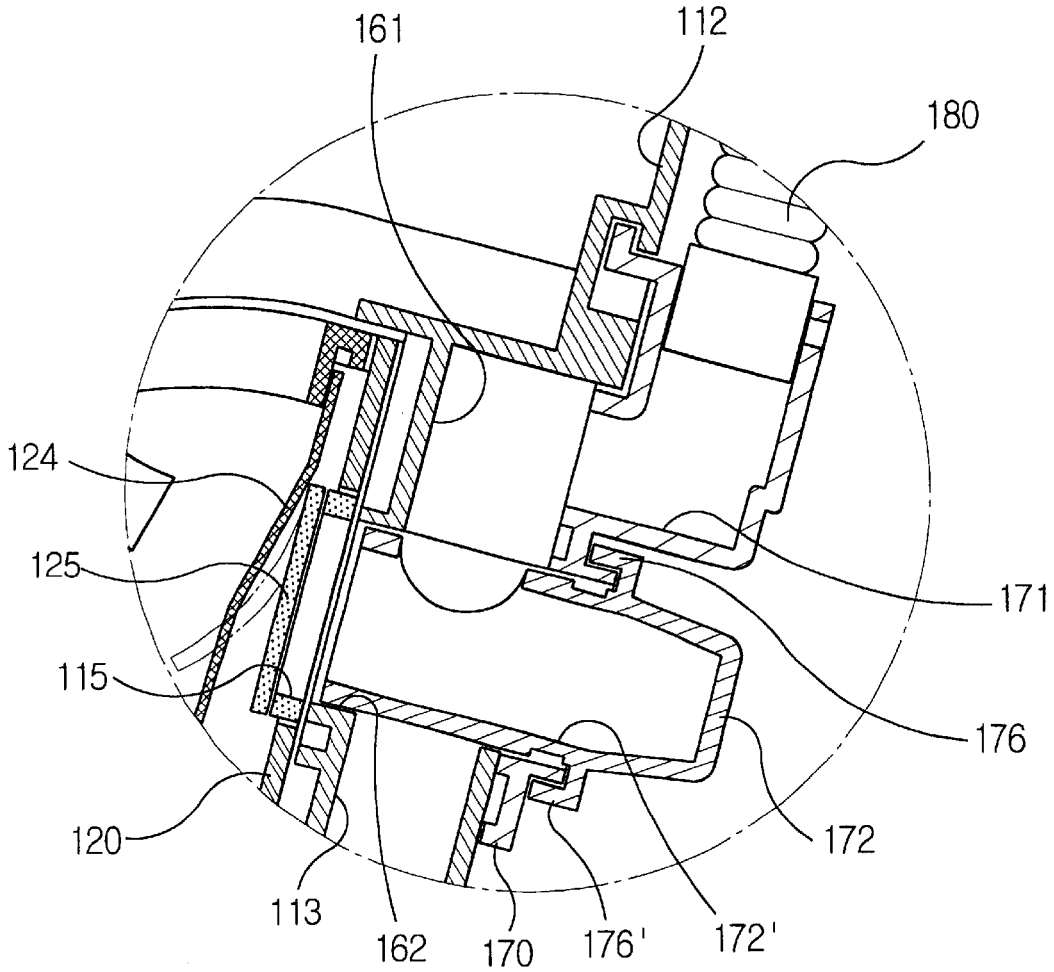
FIG. 7 is an expanded sectional view for showing the main portion of FIG. 6.
Figure 8:
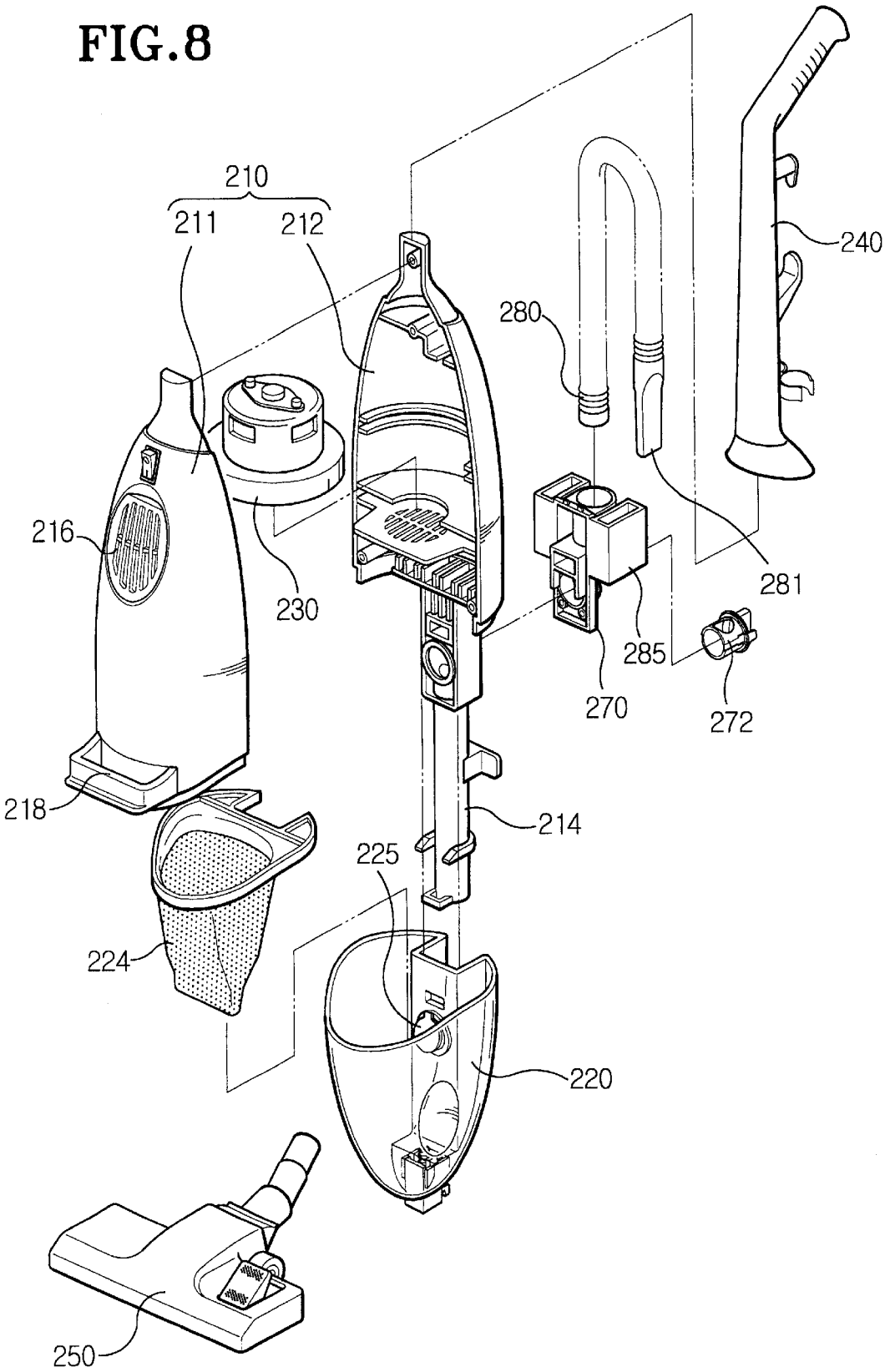
FIG. 8 is an exploded perspective view for showing a stick-type vacuum cleaner according, to another preferred embodiment of the present invention.

Meanwhile, in order to clean the recessed places such as the comers of stairs, or a wall, or gaps between floorboards, etc., the user turns the valve 172 in the direction as shown in FIGS. 6 and 7. Then, the user draws the auxiliary tool 181 from the auxiliary tool holder 185, and begins the cleaning process.

In this situation, since the main suction channel 113 is blocked by the valve 172, the air is generated, and flows through the auxiliary tool 181, the flexible hose 180, the connecting channel 171, the auxiliary suction channel 161, and the auxiliary suction port 162, and then into the dust collecting cup 120.

Accordingly, without having to replace the brush assembly 150 with the auxiliary tool 181, the user can perform the cleaning process with the auxiliary tool 181. Further, since the auxiliary tool 181 is connected with the flexible hose 180, the user also need not hold the vacuum cleaner with both hands but simply moves the auxiliary tool 181 in order to perform the cleaning process.

Meanwhile, FIGS. 8 to 13 show a stick-type vacuum cleaner according to another preferred embodiment of the present invention. Referring to FIGS. 8 to 11, the stick-type vacuum cleaner according to another preferred embodiment of the present invention includes a body 210, a dust collecting cup 220, a motor-fan system 230, and a handle 240.

The body 210 includes first and second housings 211 and 212 which are coupled with each other by coupling means (not shown) such as screws, etc. The first and second housings 211 and 212 define a space therebetween as they are coupled with each other, and the motor-fan system 230 is disposed in the space.

A suction pipe 214 having a main suction channel 213 therein, is formed on one side of the second housing 212. An auxiliary suction channel 261 is formed near the main suction channel 213, while being separated from the main suction channel 213. To an upstream portion of the suction pipe 214, a brush assembly 250 is detachably connected for floor cleaning.

The dust collecting cup 220 is detachably connected to one side of the body 210, and has main and auxiliary suction ports 215 and 262 which are communicated with the main and auxiliary suction channels 213 and 261 of the second housing, respectively.

A valve plate 225 is formed at the main suction port 215, for preventing a back flow of the dust which flows in the dust collecting cup 220. A filter 224 is disposed at an outlet portion of the dust collecting cup 220, for filtering out the dust from the air flowing in the dust collecting cup 220, and for collecting the dust.

An adaptor body 270 is connected with the second housing 212, and has a connecting channel 271 formed on one side thereof which is communicated with the auxiliary suction channel 261 of the second housing 212. The connecting channel 271 is connected with one side of the flexible hose 280, while the other side of the flexible hose 280 is connected with the auxiliary tool 281 for cleaning recessed places.

Figure 11:
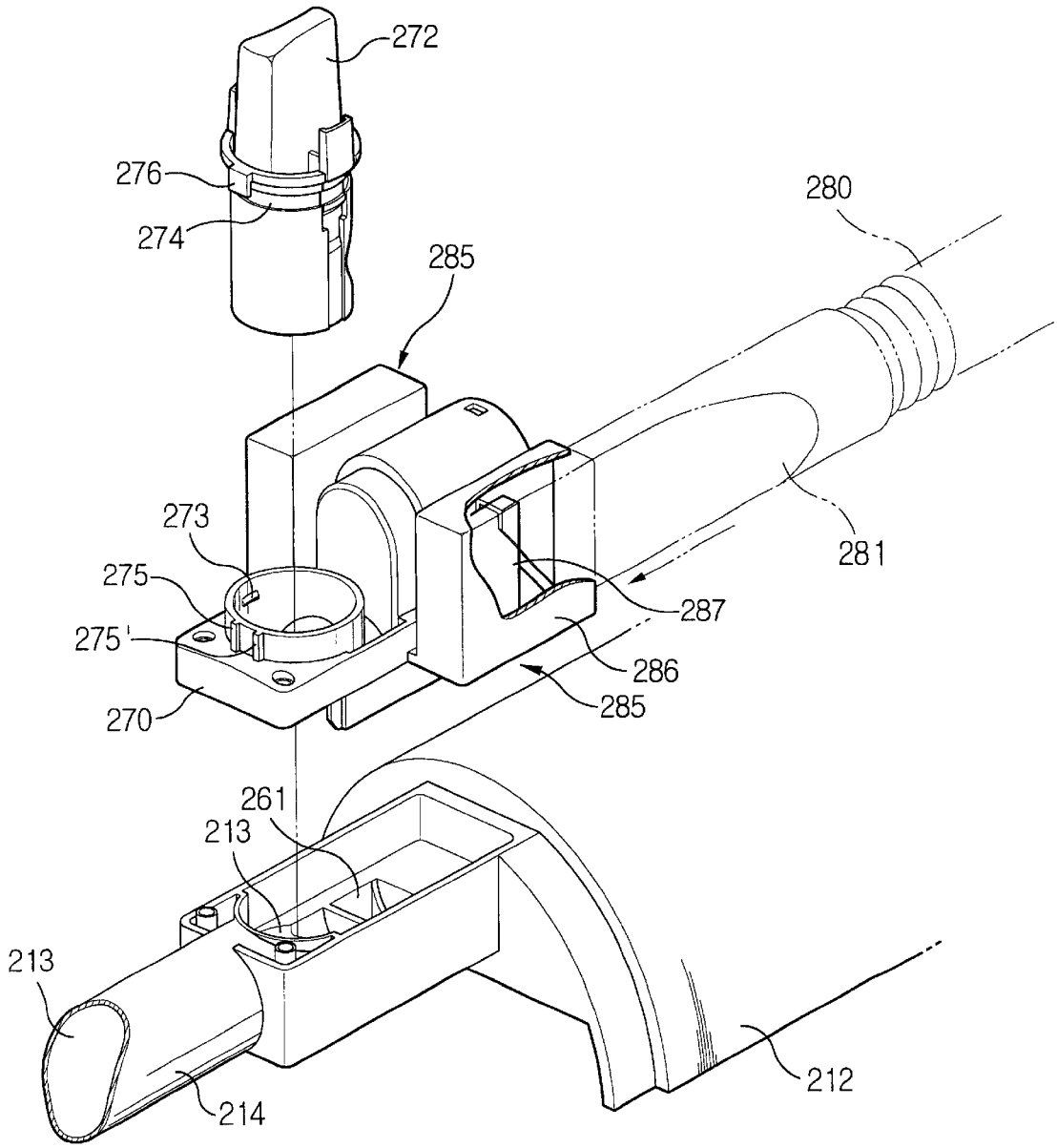
FIG. 11 is an exploded perspective view for showing the main portion of a stick-type vacuum cleaner according to yet another preferred embodiment of the present invention.

A valve 272 is connected to the adaptor body 27, to selectively block the main suction channel 213 (See FIG. 11). Referring to FIG. 11, the reference numeral 273 is a valve separating prevention protrusion, which prevents the separation of the valve 272 from the adaptor body 270, by being fitted in the recess 274 formed on the valve 272.

Further, reference numerals 275 and 275' are valve turning prevention protrusions. The locking protrusions 276 and 276' are formed on the valve 272 (See FIG. 11). As the locking protrusions 276 and 276' are selectively placed between the pair of valve turning prevention protrusions 275 and 275', the valve completely opens the main suction channel 213 (See FIG. 10), or completely closes the main suction channel 213 (See FIG. 13).

Further, caps 285 are integrally formed on both sides of the connecting channel 271 of the adaptor body 270, for selectively blocking the air suction through the connecting channel 271 (See FIG. 11). The number of caps 285 is not limited, so that there may be one cap 285. For convenience in handling, however, the embodiment of the present invention employs two caps 285.

An outlet portion of the auxiliary tool 281 is detachably inserted in the cap 285, and accordingly, the outlet of the auxiliary tool 281 is blocked, and the air suction through the flexible hose 280 and through the auxiliary suction channel 261 is blocked.

The cap 285 is in the shape of a box whose one side is open, and has an outer ring 286 to receive the outlet portion of the auxiliary tool 281, and an inner ring 287 to be inserted in the outlet portion of the auxiliary tool 281, when the auxiliary tool 281 is inserted in the cap 285. By the cooperation of the outer and inner rings 286 and 287, the inlet of the auxiliary tool 281 is completely blocked.

The motor-fan system 230 functions to generate an air flow moving through the main suction channel 213 and the auxiliary suction channel 261, and then into the dust collecting cup 220. At the upstream portion of the motor-fan system 230, a filter 217 is disposed to prevent dust from being suctioned into the motor-fan system 230.

A plurality of discharge slots 216 are formed on the first housing 211 for permitting the air, which is suctioned by the motor-fan system 230, outward therethrough, and an auxiliary handle 218 is formed on the upper surface of the first housing 211 for enabling the user to handle the vacuum cleaner more easily when cleaning the recessed places such as stairways, etc.

A detaching button 222 having a hook 221 is formed at the front lower side of the dust collecting cup 220, while being biased outward by a spring 223, and the interlocking protrusion 221' is formed on the second housing 211 at a position corresponding to the hook 221 of the detaching button 222 to be interlocked with the hook 221. By manipulating the detaching button 222, the dust collecting cup 220 is connected/disconnected to/from one side of the body 210.

Figure 9A:
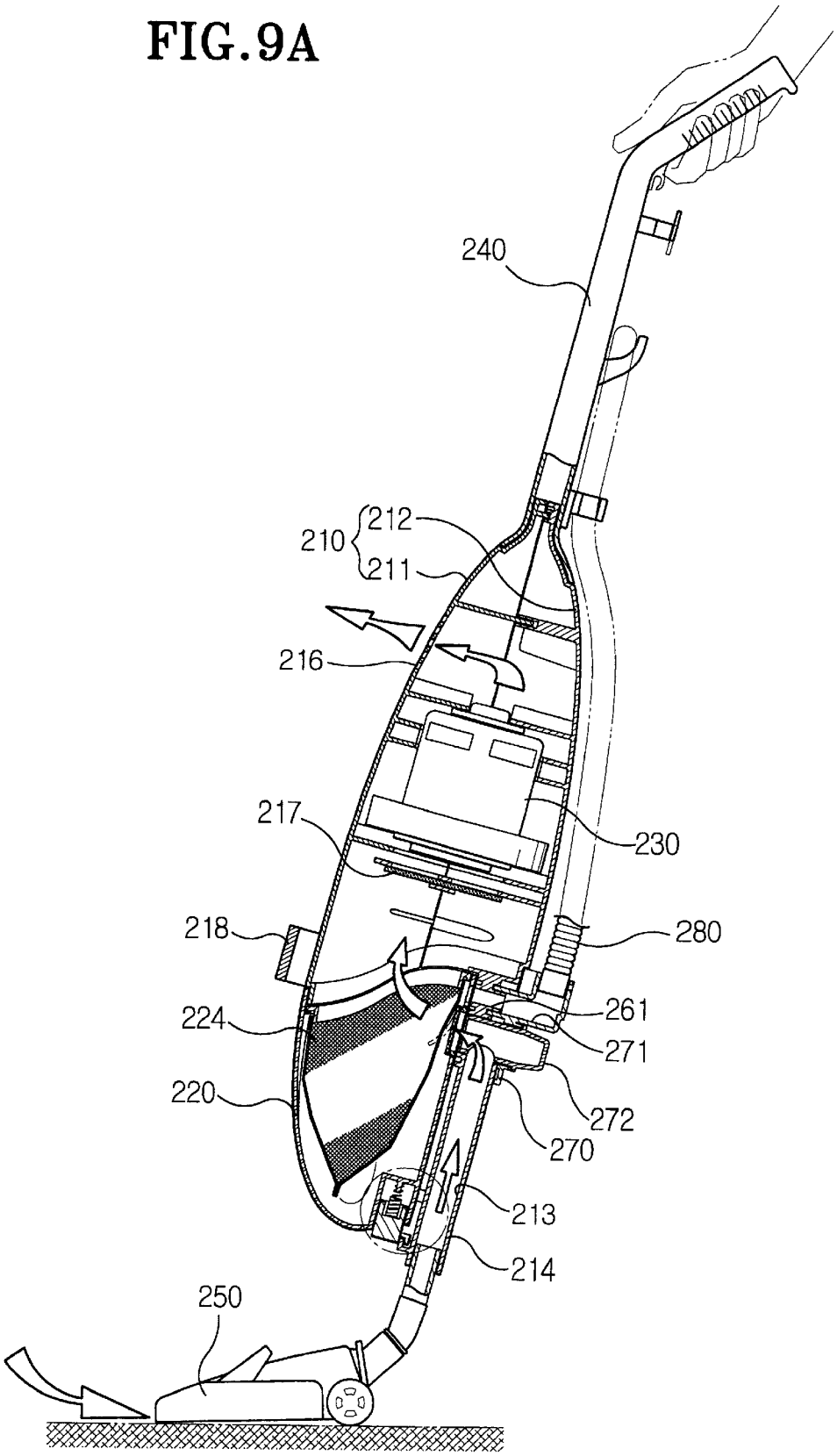
FIG. 9A is a sectional view of the stick-type vacuum cleaner according to another preferred embodiment of the present invention, showing a user cleaning a floor with the brush assembly.
Figure 9B:
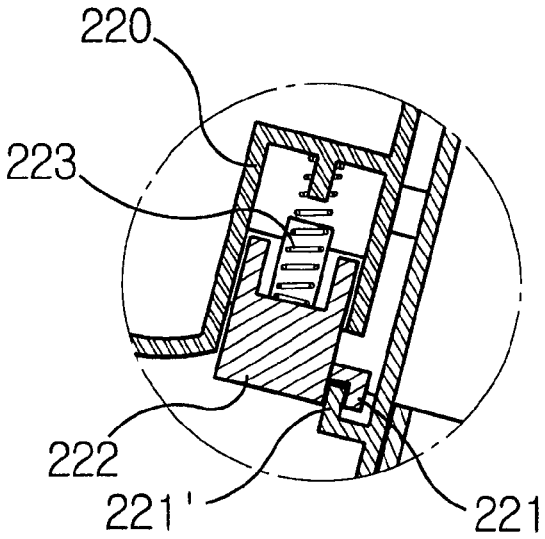
FIG. 9B is an expanded sectional view for showing the main portion of the stick-type vacuum cleaner of FIG. 9A.
Figure 10:
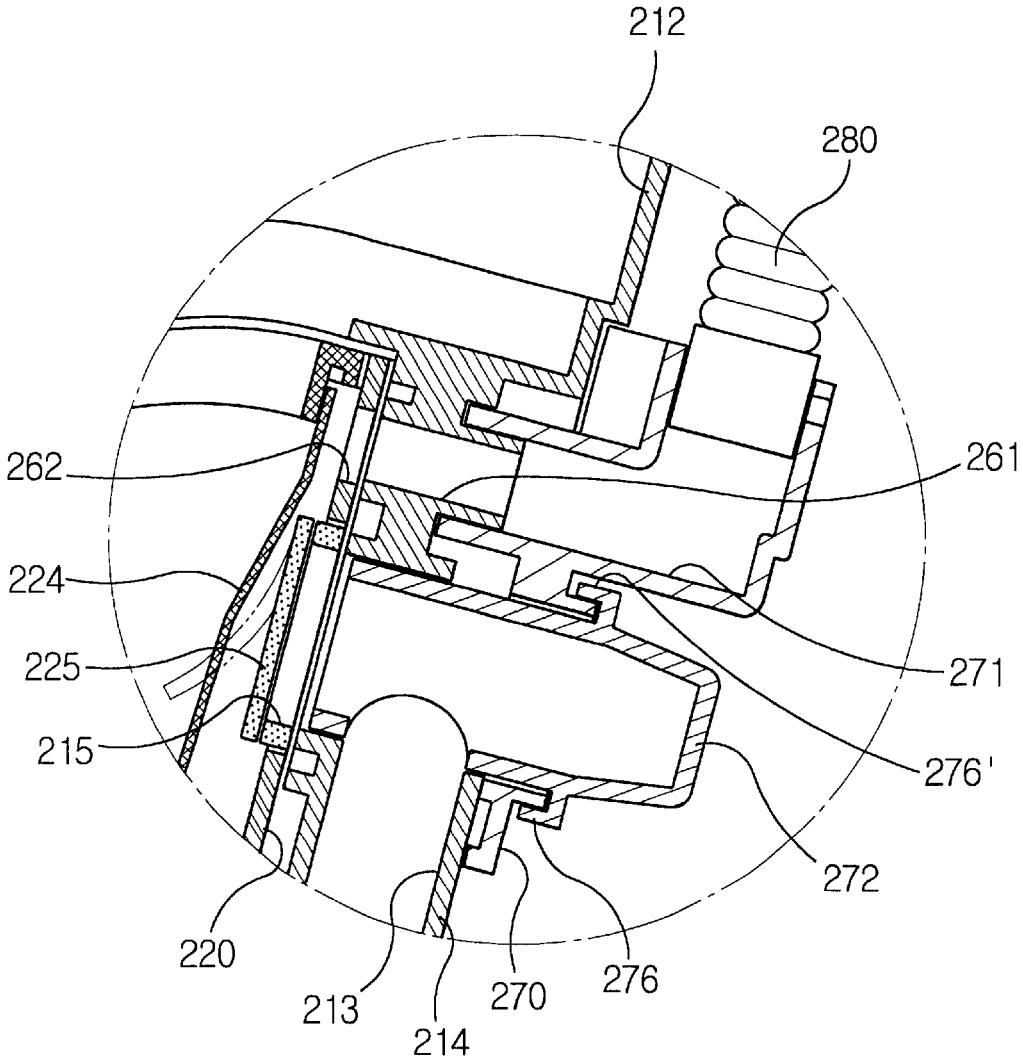
FIG. 10 is an expanded sectional view for showing the main portion of the stick-type vacuum cleaner of FIG. 9A.

In the stick-type vacuum cleaner constructed as above according to another preferred embodiment of the present invention, when the valve 272 and the auxiliary tool 281 are at the position as shown in FIGS. 9A and 10, the air is not suctioned through the auxiliary tool 281.

Accordingly, when the motor-fan system 230 is operated, the air flow is generated, moving through the brush assembly 250, the main suction channel 213, and the main suction port 215, and then into the dust collecting cup 220.

As a result, the dust and air that are sucked into the brush assembly 250, flow through the main suction channel 213 and the main suction port 215, and then into the dust collecting cup 220, where the dust is filtered out by the filter 224 disposed therein.

Accordingly, in order to clean the floor, the user moves the vacuum cleaner while holding the handle of the vacuum cleaner, and while keeping a close contact of the lower side of the brush assembly 250 with the floor. Automatically, the floor cleaning process is performed as the dust on the floor is suctioned into the vacuum cleaner.

Figure 12:
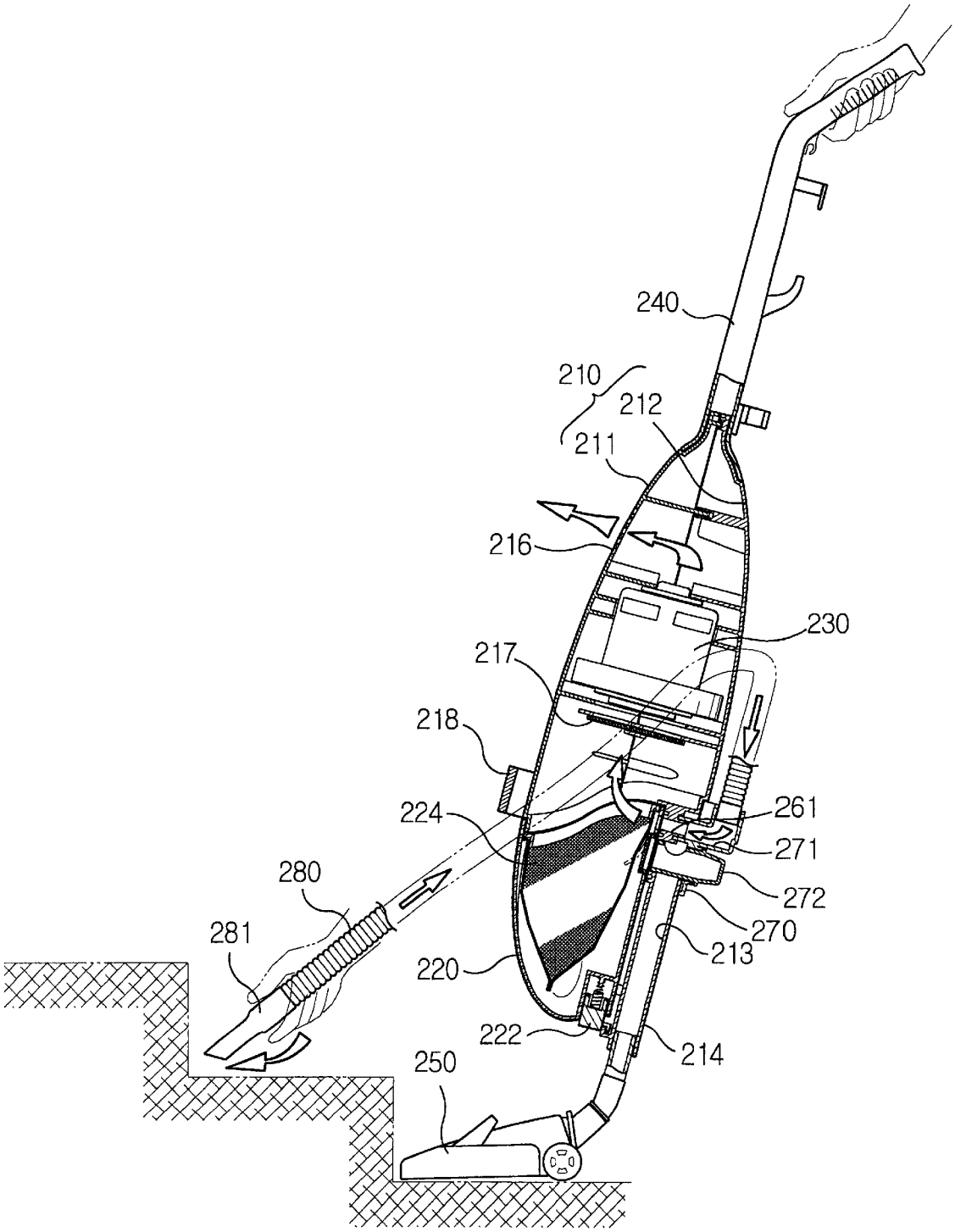
FIG. 12 is a sectional view of the stick-type vacuum cleaner according to yet another preferred embodiment of the present invention, showing a user cleaning a stair with an auxiliary tool.
Figure 13:
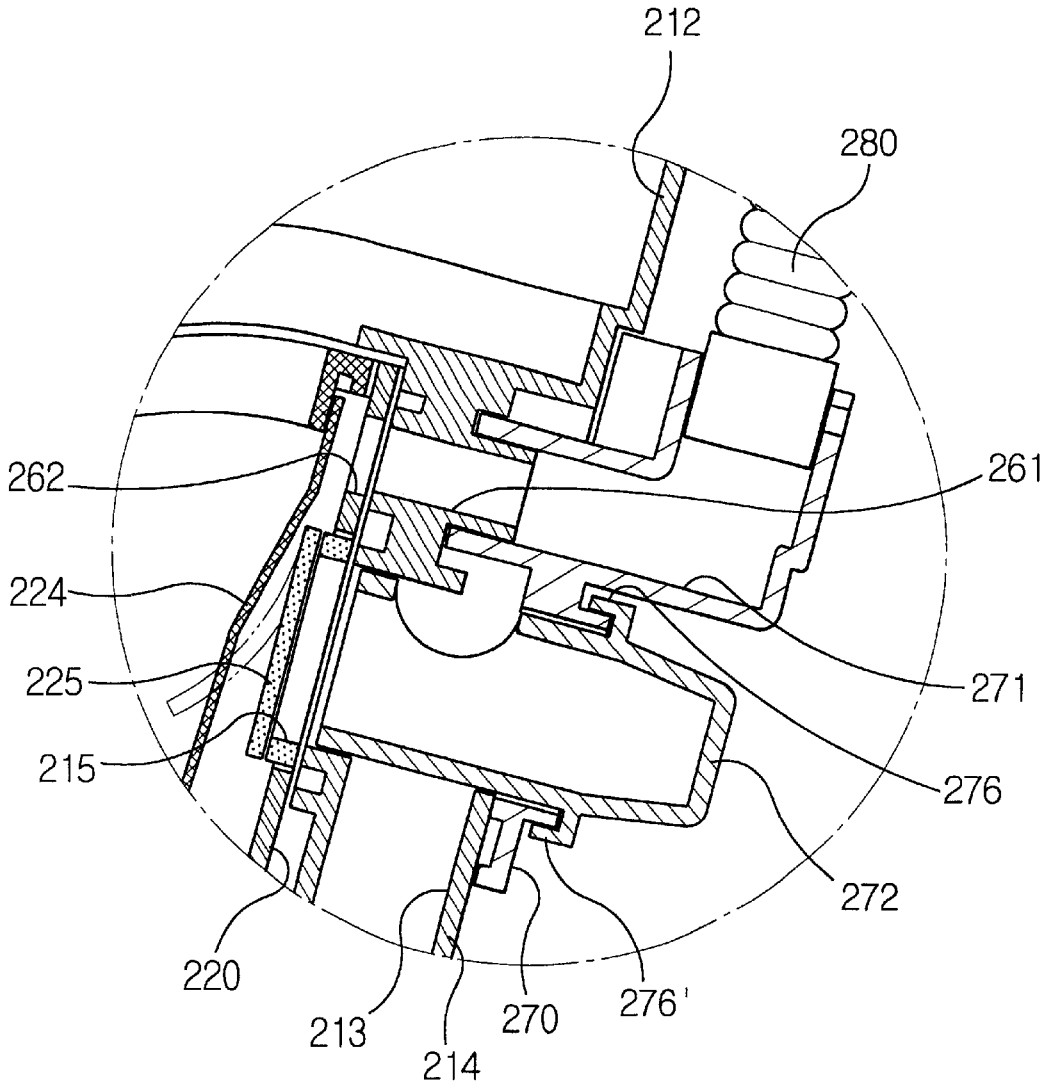
FIG. 13 is an expanded sectional view for showing the main portion of FIG. 13.

Meanwhile, in order to clean the recessed places such as the comers of a room, stairways, or gaps between floor boards, etc., the user turns the valve 272 to the position as shown in FIGS. 12 and 13, and draws the auxiliary tool 281 from the cap 285 for use.

In this situation, since the main suction channel 213 is blocked by the valve 272, the air flow is generated to move through the auxiliary tool 281, the flexible hose 280, the connecting channel 271, the auxiliary suction channel 261, and the auxiliary suction port 262, and then into the dust collecting cup 220.

Accordingly, without having to replace the brush assembly 250 with the auxiliary tool 281, the user can perform the cleaning process with the auxiliary tool 281, conveniently. Further, since the auxiliary tool 281 is connected with the flexible hose 280, the user can clean the desired places by simply moving the auxiliary tool 281, not by holding the vacuum cleaner with both hands during the cleaning process.

As stated above, a preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. A stick-type vacuum cleaner comprising:

a dust collecting cup having a suction port formed thereon;

a body having main and auxiliary suction channels communicating with said suction port;

an adaptor body connected to the body, having a connecting channel communicated with the auxiliary suction channel;

a hose arranged to communicate with the auxiliary suction channel through the connecting channel, the hose having an inlet coupled to an auxiliary tool;

a valve rotatably connected with the adaptor body at a position where the main and auxiliary suction channels meet, said valve having a hollow cylinder, an opening formed on one end of said hollow cylinder communicating with said suction port, and a hole formed on a peripheral surface of said hollow cylinder, said hole communicating with said opening and selectively communicating with one of the main suction channel and the auxiliary suction channel; and a motor-fan system for generating an air flow which moves through the main and auxiliary channels and then into the dust collecting cup.

2. The stick-type vacuum cleaner as claimed in claim 1, wherein the adaptor body comprises a valve separating prevention protrusion to be fitted in a recess formed on the valve, for preventing the separation of the valve from the adaptor body.

3. The stick-type vacuum cleaner as claimed in claim 2, wherein the adaptor body comprises a pair of valve turning prevention protrusions, between which locking protrusions formed on the valve are selectively placed to communicate the main suction channel or the auxiliary suction channel with the suction port.

4. The stick-type vacuum cleaner as claimed in claim 1, further comprising auxiliary holders integrally formed on both sides of the connecting channel of the adaptor body to hold the auxiliary tool.

5. A stick-type vacuum cleaner comprising:

a body having main and auxiliary suction channels;

a dust collecting cup having main and auxiliary suction ports which are communicated with the main and auxiliary suction channels, respectively;

a flexible hose arranged to be communicated with the auxiliary suction channel, the flexible hose whose inlet portion is attached to an auxiliary tool;

means for selectively blocking the main suction channel;

means for selectively blocking air suction through the auxiliary suction channel; and a motor-fan system for generating an air flow which moves through the main suction channel and the auxiliary suction channel and then into the dust collecting cup.

6. The stick-type vacuum cleaner as claimed in claim 5, wherein the main suction channel blocking means is a valve formed on the main suction channel.

7. The stick-type vacuum cleaner as claimed in claim 6, wherein the valve is rotatably connected with the adaptor body connected with the lower side of the body.

8. The stick-type vacuum cleaner as claimed in claim 7, wherein the adaptor body comprises a valve separating prevention protrusion for preventing the separation of the valve from the adaptor body by being fitted in a recess formed on the valve.

9. The stick-type vacuum cleaner as claimed in claim 8, wherein the adaptor body comprises a pair of valve turning prevention protrusions, between which locking protrusions are placed so as to maintain the valve at a position to completely open or close the main suction channel.

10. The stick-type vacuum cleaner as claimed in claim 9, wherein the means for blocking the air suction through the auxiliary suction channel, is a cap for blocking an inlet of the auxiliary tool by being fitted with an inlet portion of the auxiliary tool.

11. The stick-type vacuum cleaner as claimed in claim 10, wherein the flexible hose is communicated with the auxiliary suction channel through the adaptor body which is connected with the body, and the cap is integrally formed on the adaptor body.

12. The stick-type vacuum cleaner as claimed in claim 11, wherein a cap is formed on both sides of the adaptor body, respectively.

13. The stick-type vacuum cleaner as claimed in claim 10, wherein the cap comprises an outer ring to receive the inlet portion of the auxiliary tool, and an inner ring to be inserted in the inlet portion of the auxiliary tool.

14. A stick-type vacuum cleaner comprising:

a dust collecting cup having main and auxiliary suction ports formed thereon;

a body having main and auxiliary suction channels communicated with the main and auxiliary suction ports, respectively;

an adaptor body connected with the body, and having a connecting channel communicated with the auxiliary suction channel;

a valve rotatably connected with the adaptor body, for selectively blocking the main suction channel of the body;

a flexible hose having one end which is connected with the adaptor body and communicated with the connecting channel, and another end which is connected with an auxiliary tool;

a cap detachably connected with an inlet portion of the auxiliary tool, to block the inlet of the auxiliary tool; and a motor-fan system for generating an air flow which moves through the main suction channel and the auxiliary suction channel, and then into the dust collecting cup.

15. The stick-type vacuum cleaner as claimed in claim 14, wherein the adaptor body comprises a valve separating prevention protrusion for preventing a separation of the valve from the adaptor body by being fitted in a recess which is formed on the valve.

16. The stick-type vacuum cleaner as claimed in claim 15, wherein the adaptor body comprises a pair of valve turning prevention protrusions, between which locking protrusions are placed so as to maintain the valve at a position to completely open or close the main suction channel.

17. The stick-type vacuum cleaner as claimed in claim 14, wherein the cap is integrally formed on the adaptor body.

18. The stick-type vacuum cleaner as claimed in claim 17, wherein the cap is formed on both sides of the adaptor body, respectively.

19. The stick-type vacuum cleaner as claimed in claim 18, wherein the cap comprises an outer ring to receive the inlet portion of the auxiliary tool, and an inner ring for inserting into the inlet portion of the auxiliary tool.

20. The stick-type vacuum cleaner as claimed in claim 17, wherein the cap comprises an outer ring to receive the inlet portion of the auxiliary tool, and an inner ring for inserting into the inlet portion of the auxiliary.

21. The stick-type vacuum cleaner of claim 1, further comprising a hose having one end coupled to said adaptor body so as to communicate with said auxiliary channel through said connecting channel while the other end of said hose is placed into an auxiliary holder formed on said adaptor body.

22. The stick-type vacuum cleaner of claim 1, said hose having one end coupled to said adaptor body so as to communicate with said auxiliary channel through said connecting channel while said valve blocks the auxiliary suction channel from said suction port.

23. The stick-type vacuum cleaner of claim 1, said hose having one end coupled to said adaptor body so as to communicate with said auxiliary channel when said valve blocks the main suction channel.

* * * * *